United States Patent [19]

Taylor, Jr. et al.

[11] Patent Number: 4,504,719

[45] Date of Patent: Mar. 12, 1985

[54] DOOR LATCH AND METHOD OF ASSEMBLY

[75] Inventors: Benson T. Taylor, Jr., Floyd Knobs, Ind.; Ralph G. Hawkins, Louisville, Ky.

[73] Assignee: General Electric Company, Louisville, Ky.

[21] Appl. No.: 580,296

[22] Filed: Feb. 21, 1984

Related U.S. Application Data

[63] Continuation of Ser. No. 351,083, Feb. 22, 1982, abandoned.

[51] Int. Cl.[3] ..... H05B 6/06

[52] U.S. Cl. ..... 219/10.55 C; 219/10.55 D

[58] Field of Search ..... 200/61.7, 250, 6 R; 219/10.55 C, 10.55 D; 292/341.18, 341.19; 126/197

[56] References Cited

U.S. PATENT DOCUMENTS

| | | | |
|---|---|---|---|
| 1,025,008 | 4/1912 | Miner . | |
| 1,857,388 | 5/1932 | Linderman et al. . | |
| 2,621,265 | 12/1952 | Alcoriza | 200/6 |
| 2,643,149 | 6/1953 | Mager | 292/341.18 |
| 2,797,269 | 6/1957 | Buck et al. | 200/31 |
| 2,820,856 | 1/1958 | Krueger | 200/21 |
| 3,715,552 | 2/1973 | Umezu et al. | 219/10.55 |
| 3,733,456 | 5/1973 | Blackburn | 219/10.55 C |
| 3,777,098 | 12/1973 | Tapper | 219/10.55 |
| 3,865,097 | 2/1975 | Robinson | 126/197 |
| 4,101,750 | 7/1978 | Doner | 219/10.55 |
| 4,201,901 | 5/1980 | Schuchert | 219/10.55 |

*Primary Examiner*—Roy N. Envall, Jr.
*Assistant Examiner*—M. M. Lateef
*Attorney, Agent, or Firm*—Frederick P. Weidner; Radford M. Reams

[57] ABSTRACT

A latch assembly in a cabinet having a front opening with a door movably mounted to the cabinet for selectively closing the opening. There is a latch secured to the door and projecting from the rear surface of the door and a mounting member attached to the cabinet having a latch receiving strike plate and a resilient finger. The mounting member is pivotally mounted at one end thereof to a rigid cabinet member with the resilient finger abutting the cabinet and biased in a direction away from the door in its closed position. The latch and mounting member strike plate cooperate to tightly retain the door in its closed position by the biasing effect of the resilient finger. The mounting member is secured against pivotal movement thereof when the latch and mounting member strike plate cooperate to tightly retain the door in its closed position.

14 Claims, 7 Drawing Figures

DOOR LATCH AND METHOD OF ASSEMBLY

This application is a continuation of application Ser. No. 351,083, filed Feb. 22, 1982 now abandoned.

BACKGROUND OF THE INVENTION

The present invention relates to a latch assembly and particularly a latch and switch arrangement and method of assembly for use with a microwave oven.

In the conventional microwave oven, a microwave energy generating device is provided for delivering microwave energy into a cavity defined by a cabinet having a front opening selectively closed by a door. To assure there is no leakage of the microwave energy from the cavity during operation of the oven, it is important that access to the oven cavity by the user is prevented when the microwave energy generating means is energized. Thus, it is conventional to provide interlocking means for assuring that the cabinet door is in the closed and latched position before the microwave energy generating means may be energized. A number of different interlocking systems have been developed to provide such functioning. Most commonly is a mechanism wherein a latch secured to the door will engage a switch secured to the oven which switch will energize the microwave energy generating device only when the door is in its closed position and when opened and the latch removed from contact with the switch the microwave energy generating device is deenergized. See for example U.S. Pat. Nos. 3,715,552; 3,777,098; 3,865,097 and 4,101,750.

To aid in the proper functioning of the interlocking system it is important that the door be tightly retained against the face of the oven cavity during operation of the microwave energy generating device. By this invention there is provided a door latch and switch arrangement and method of assembly for microwave ovens which assures that the door is tightly closed and the latch on the door properly actuates and deactuates the switch that energizes and deenergizes the microwave energy generating device respectively.

SUMMARY OF THE INVENTION

In accordance with one aspect of the present invention, there is provided a latch assembly in a cabinet having a front opening with a door movably mounted to the cabinet for selectively closing the opening. There is a yieldable latch movable to latched and unlatched positions secured to the door and projecting from the rear surface of the door and a mounting member attached to the cabinet having a latch receiving strike plate and a resilient finger. The mounting member is pivotally mounted at one end thereof to a rigid cabinet member with the resilient finger abutting the cabinet and biased in a direction away from the door in its closed position. The latch and mounting member strike plate cooperate to tightly retain the door in its closed position by the biasing effect of the resilient finger. The mounting member is secured against pivotal movement thereof when the latch and mounting member strike plate cooperate to tightly retain the door in its closed position.

DESCRIPTION OF THE PREFERRED EMBODIMENT

Figure 1:
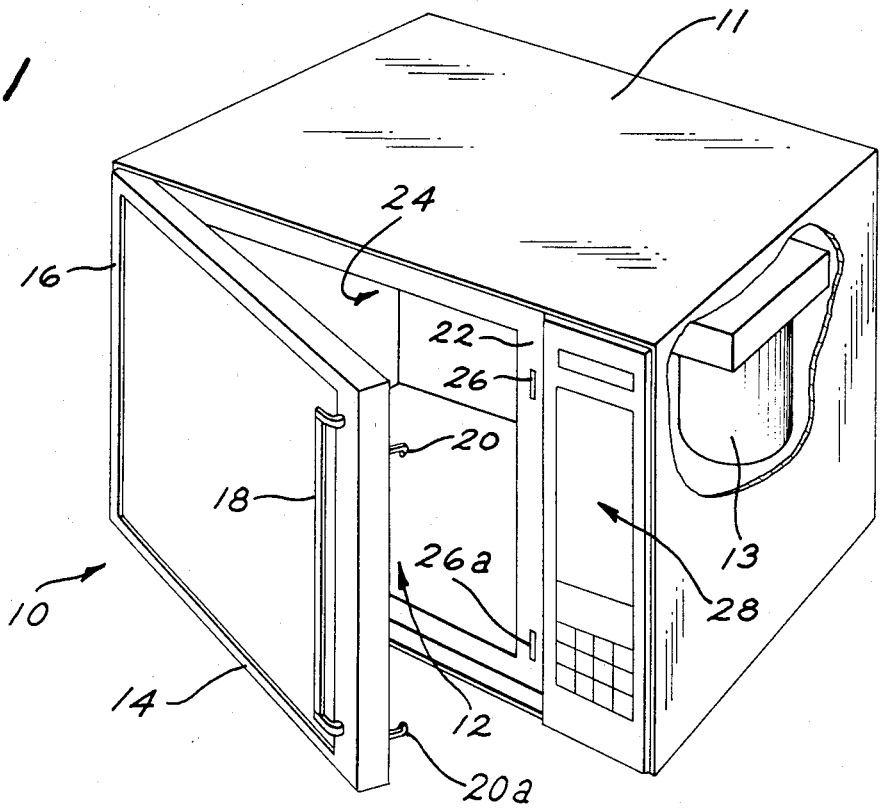
FIG. 1 is a perspective view of a countertop microwave oven with the door open showing a portion of the latch assembly of the present invention.
Figure 2:
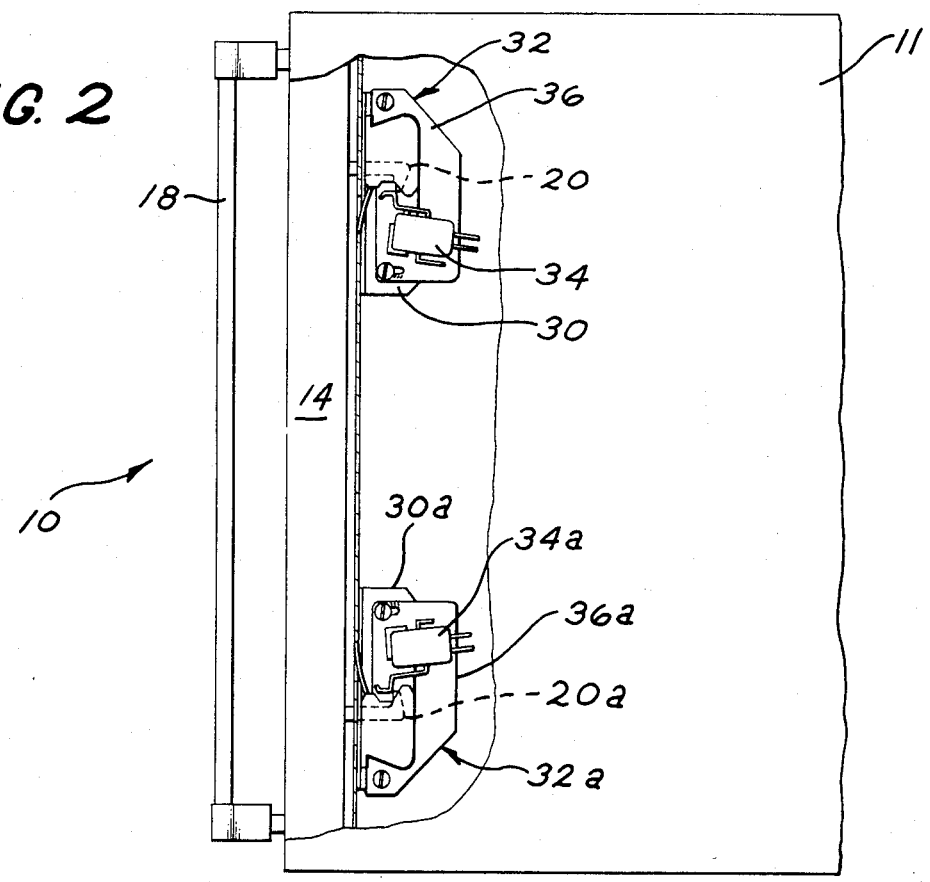
FIG. 2 is a side elevational view of the countertop microwave oven shown in FIG. 1 with a portion of the cabinet broken away to show the latch assembly when the door is closed.

Referring to FIGS. 1 and 2, there is shown a microwave oven 10 comprising an outer casing or cabinet 11 enclosing a cooking cavity 12. An electrically operable microwave energy generating means 13 is provided for supplying electromagnetic energy to the cavity 12 in the conventional manner. The front opening of the cavity 12 is closed by door 14 hinged at one end 16 and having a handle 18 at the opposite end with yieldable latches 20 and **20*a* movable to latched and unlatched positions which are received through the front face 22 that surrounds the opening 24 through slot openings 26 and 26*a*** respectively when the door is in its closed position.

The front of the microwave oven 10 has a control panel 28 so that the user may control the energization and deenergization of the microwave energy generating means 13 when the door is closed and also select the desired mode of cooking. Behind and welded or otherwise attached to the front face 22 of the microwave oven 10 is a rigid oven member 30 and **30*a*, a portion of which is adjacent to the control panel 28. As seen in FIG. 2, attached to the oven rigid members 30 and 30*a* behind the slot openings 26 and 26*a* are switch assemblies 32 and 32*a*. The switch assemblies 32 and 32*a* include switches 34 and 34*a* rigidly secured to mounting members 36 and 36*a* which mounting members are secured to the oven rigid members 30 and 30*a* as will be explained hereinafter. The rigid members 30 and 30*a* and switch assemblies 32 and 32*a* are identical as far as concerning this invention and are merely mounted in the oven in an opposing manner. They do operate in an identical manner even though the respective switches may serve different purposes. Therefore, the structural arrangement and operation of the latch and switch assemblies and oven rigid members will be described with regard to latch 20, switch assembly 32, and oven rigid member 30 and the corresponding elements for latch 20*a*, switch assembly 32*a*, and oven rigid member 30*a*** will be designated with the small letter "a."

Figure 3:
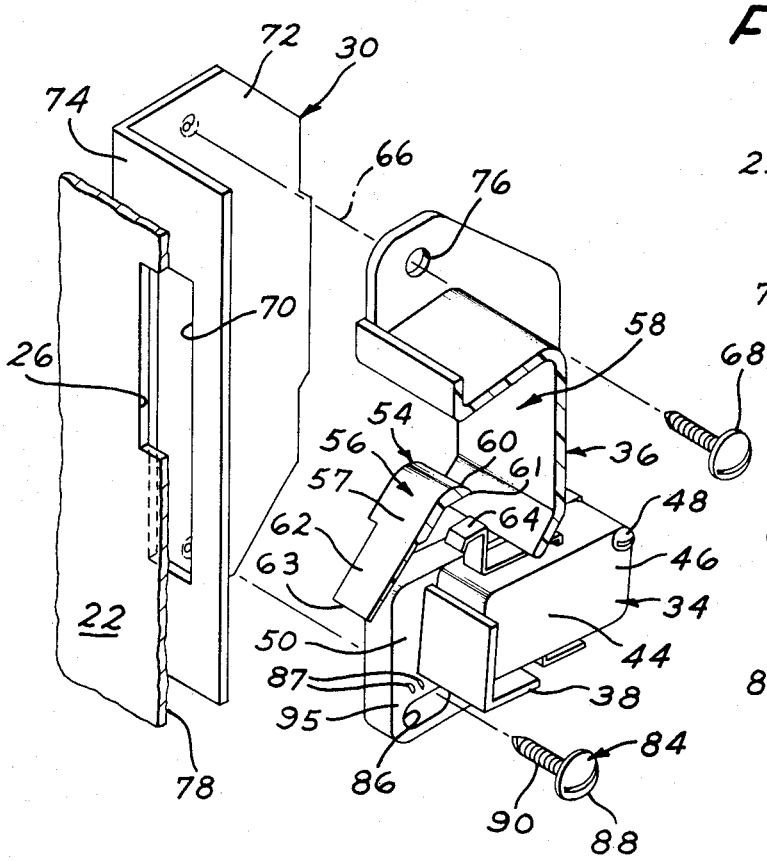
FIG. 3 is an exploded perspective view of a portion of the latch assembly of the present invention.
Figure 4:
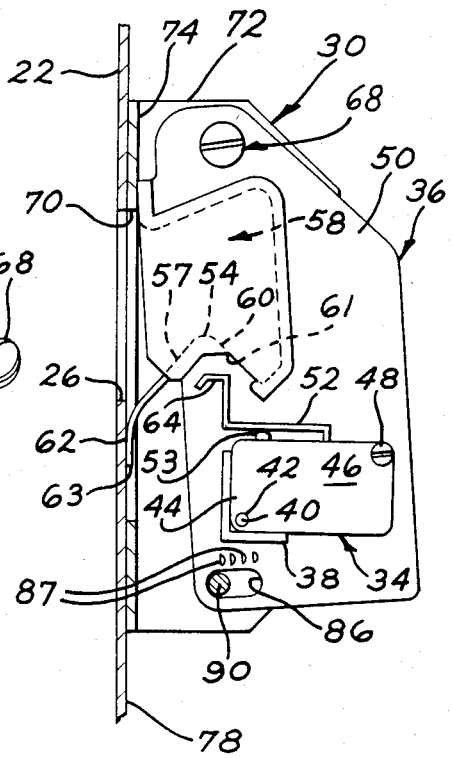
FIG. 4 is a side elevational view showing the portion of the latch assembly shown in FIG. 3 assembled with a microwave oven.

With reference to FIGS. 3 and 4 there is shown the arrangement of switch assembly 32 wherein in the preferred embodiment the mounting member 36 is molded from suitable plastic material and includes a means for securely fastening the switch 34 to the mounting member 36 which means in the preferred embodiment includes an integrally molded two sided bracket 38 and having within the bracket an upstanding projection 40 which is received in an opening 42 in the switch 34 so that the switch may be placed within the bracket and its one end 44 retained within the bracket 38. The opposite end of the switch 46 has a screw fastener 48 that passes through an opening in the switch 46 and is securely fastened to the base plate 50 of the mounting member 36. In this manner the switch 34 may be quickly and easily securely fastened to the mounting member 36. The switch 34 has an actuating arm 52 which is utilized in the usual manner such that depression of the actuating arm depresses a button 53 that actuates the switch and release of the actuating arm releases the button and deactuates the switch.

The mounting member 36 has integrally molded therewith a latch receiving strike plate 54 which has a surface 56 with an inclined portion 57 that extends into a latch receiving cavity 58 and a downwardly depending portion 60 terminating at end 61. The opposite end of the surface 56 from end 61 has a flexible finger 62 that has a terminal end 63 extending beyond the base plate 50, the purpose of which will be explained later. The downwardly depending surface 60 of the strike plate 54 is arranged to overlie a hook-shaped portion 64 of the switch actuator arm 52 and is spaced just above the hook-shaped portion.

At one end of the mounting member 36, which in FIGS. 3 and 4 is the upper end for switch assembly 32, is a means for pivotally mounting the mounting member to the oven rigid member 30. In this embodiment there is an aperture 76 through which passes a fastening screw 68 which is secured to the rigid member 30. The aperture allows pivotal movement of the mounting member about the screw 68, the pivotal axis being designated 66 in FIG. 3.

Figure 5:
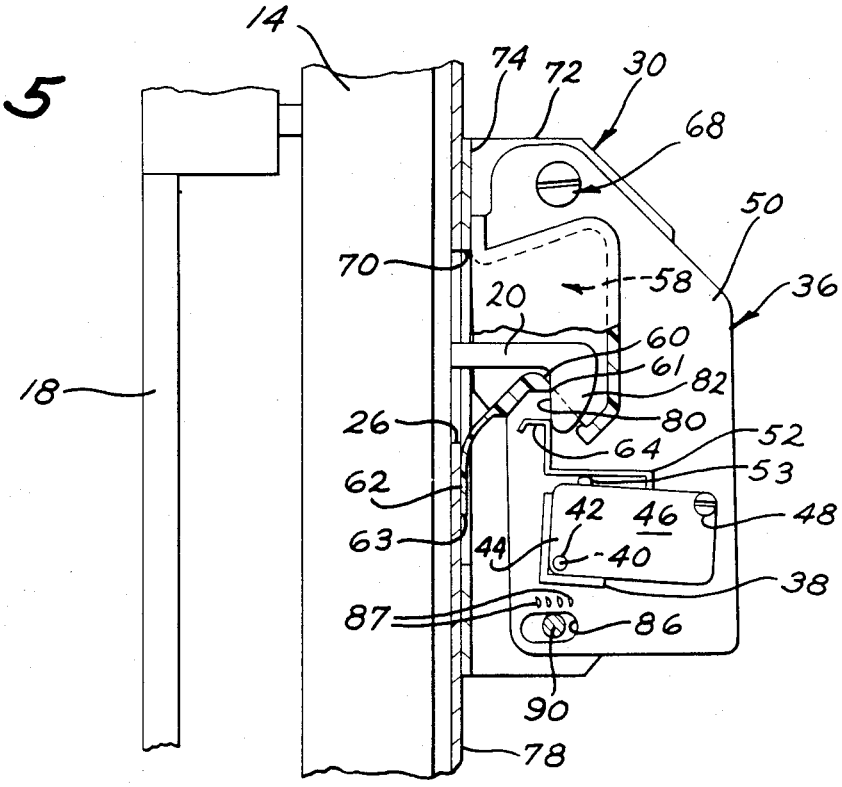
FIG. 5 is a side elevational view showing the latch assembly of the present invention with the microwave oven door in its tightly closed position.

With the latch assembly structure described above the method of assembly will now be discussed. Behind and attached to the front face 22 of the microwave oven is the rigid member 30 having right angle legs 72 and 74. Leg 74 is preferably welded to the front face 22 and has a slot opening 70 in alignment with the slot opening 26 in the front face 22. In the preferred embodiment, slot opening 70 is vertically longer than the slot opening 26 in the front face. The switch assembly 32 is positioned so that the latch receiving cavity 58 is located behind the slot opening 70 and that the latch receiving strike plate 54 has a portion thereof accessible through the opening 70. This arrangement is best seen in FIG. 4. The fastening screw 68 is passed through the aperture 76 and is secured to leg 72 of the oven rigid member 30. The flexible finger 62 of the mounting member 36 extending beyond the base plate 50 is received in slot opening 70 and abuts the rear surface 78 of the front face 22 below the slot opening 26. Due to the resilience of the finger 62 it exerts force to rotate the switch assembly 32 about the pivot 66 in a direction away from the door when it is in its closed position. This position is shown in FIG. 4. To complete assembly of the latch mechanism the door 14 is closed so that latch 20 passes through opening 26 in the front face 22 and through the opening 70 in the oven rigid member 30 and comes into contact with surface 56 of the latch receiving strike plate 54. Upon continued movement of the door to its fully closed position the latch 20 rides up and over the latch receiving strike plate 54 such that the rear surface 80 of the downwardly depending hook projection 82 of the latch 20 abuts the downwardly depending surface 60 of the strike plate 54 at terminating end 61. When the latch 20 and strike plate 54 are so engaged the flexible finger 62 exerts force to rotate the mounting member 36 about the pivot 66 in a counterclockwise direction as shown in FIG. 5. It will be understood that by such an arrangement the door is held tightly closed and in the event manufacturing tolerances for the structure prevent the door from being held tightly against the front face 22 they will be overcome by the adjustment of the position of the switch assembly 32 relative to the latch 20 in the manner just described.

On completion of the above-described assembly operation the switch assembly 32 is retained in its proper position by a screw fastener 84 passing through a slot opening 86 in the base plate 50 of the mounting member 36 and secured to leg 72 of the oven rigid member 30. The slot opening 86 is utilized so that the switch assembly may be secured against rotation in whatever position is correct for maintaining the door in its tightly closed position with the latch 20 cooperating with the latch receiving strike plate 54 so that there is in effect no slack or looseness in the latch assembly.

Figure 6:
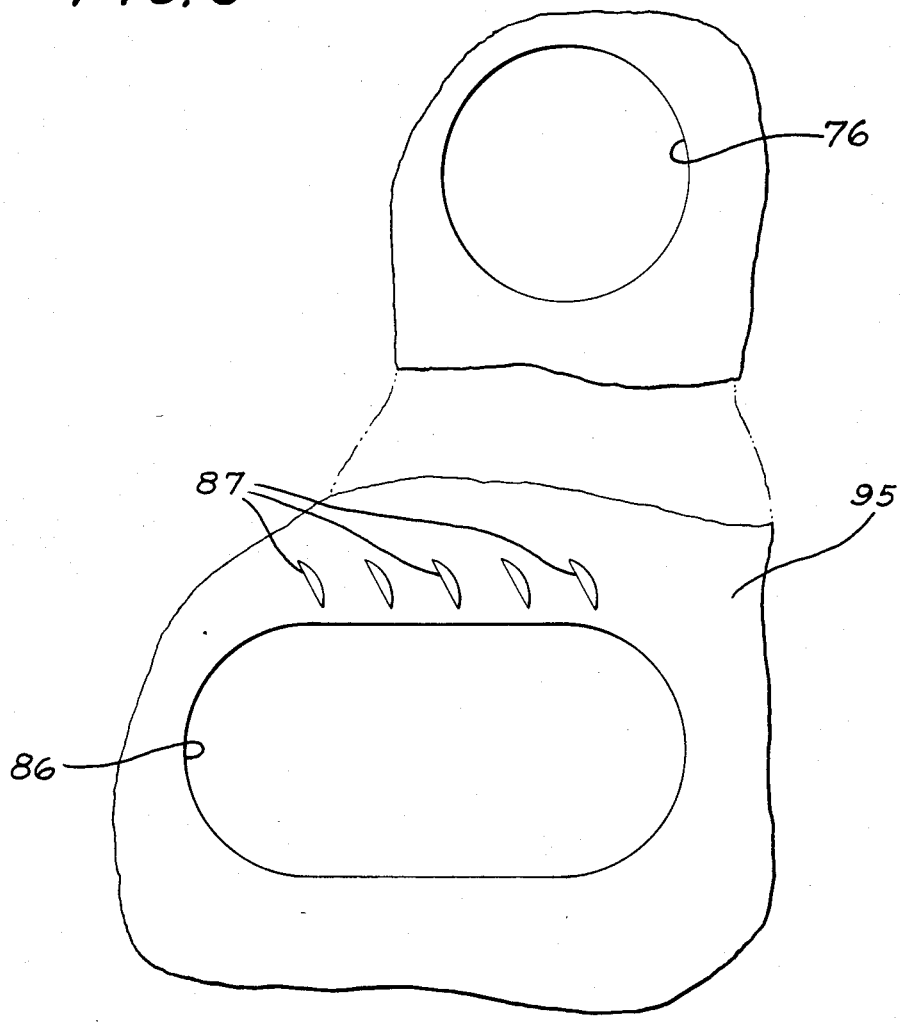
FIG. 6 is a plan view of a portion of the latch assembly of the present invention.
Figure 7:
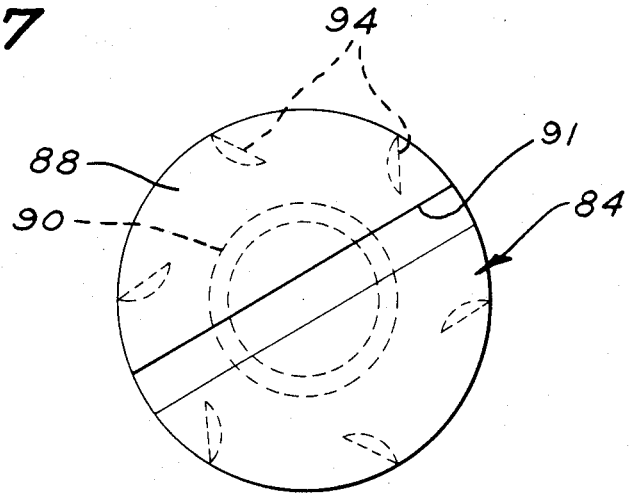
FIG. 7 is a top plan view of a screw head utilized in the present invention.

To aid in establishing the final proper fixed location of the switch assembly 32 there is provided a set of nibs 87 or upstanding small projections as most readily seen in FIG. 6. In the preferred embodiment these nibs are as viewed in top plan shaped like a small segment of a circle with the chord of the circle being toward the closed door. These nibs may be molded integrally with the base plate 50. The screw fastener 84 has a head 88 and a threaded body 90 with the head having an appropriate indentation 91 to receive a driving tool. The lower surface 92 of the head 88 has a set of depending nibs 94 around the circumference and near the periphery thereof. These nibs 94 are similarly shaped to the nibs 87 on the base plate 50 adjacent the slot opening 86 and project downwardly toward the base plate 50 when the threaded body 90 of the screw is passed through the slot 86. When the lower surface 92 comes into contact with the upper surface 95 of the base plate 50 the set of nibs 94 on the screw fastener 84 come in contact with the set of nibs 87 on the base plate 50 and engage them in such a manner that continued clockwise rotation of the screw fastener 84 to tighten the screw forces the switch assembly 32 to rotate away from the closed door if there is any tolerance between the rear surface 80 of latch 20 and the terminating end 61 of the downwardly depending surface 60 of the strike plate 54. By this arrangement and method of assembly the turning or tightening of the screw will pick up any slight tolerance left and also prevent the switch assembly from being displaced from its proper location during final tightening of the screw thereby securing the switch assembly 32 to the oven rigid member 30.

In the preferred embodiment of the invention switch 34 is utilized through appropriate electrical control means to permit energization of the microwave energy generating means 13 only if the door 14 is tightly closed thus having latch 20 retained in the latch receiving cavity 58 of the switch assembly and depressing the actuator arm 52 of switch 34. Upon unlatching and opening the door 14 switch 34 is deactuated and the microwave energy generating means is deenergized. Switch assembly 32*a* and latch 20*a* function in the same manner, however, switch 34*a* enables and disenables the control system of the microwave oven in response to closing and opening the door 14 respectively.

While, in accordance with the patent statutes, there has been described what at present is considered to be the preferred embodiment of the invention. It will be obvious to those skilled in the art that various changes and modifications may be made thereto without departing from the invention. It is, therefore, intended by the appended claims to cover all such changes and modifications as fall within the true spirit and scope of the invention.

We claim:

1. A latch assembly in a cabinet having a front opening with a door movably mounted to said cabinet for selectively closing said opening comprising:

a latch secured to the door and projecting from the rear surface of the door, a mounting member attached to the cabinet having a latch receiving strike plate and a resilient finger and pivotally mounted at one end thereof to a rigid cabinet member with the resilient finger abutting the cabinet and biased in a direction away from the door in its closed position, said latch and mounting member strike plate being movable relative to each other to latched and unlatched positions and cooperating to tightly retain the door in its closed position by the biasing effect of the resilient finger when in the latched position, and means fixedly securing the mounting member against pivotal movement thereof when the latch and mounting member strike plate cooperate to tightly retain the door in its closed position.

2. The latch assembly of claim 1 wherein the mounting member has secured thereto a switch, which switch is actuated by contact with the latch when the door is in its closed position.

3. In the latch assembly of claim 1 wherein means fixedly securing the mounting member against pivotal movement include an elongated slot opening in the mounting member and a headed screw fastener through the slot opening into a rigid cabinet member.

4. The latch assembly of claim 3 wherein the slot opening has a set of upstanding nibs longitudinally along a side of the slot and the lower surface of the screw fastener head has a set of depending nibs which nibs cooperate with the nibs on the mounting member so that upon tightening of the screw fastener the sets of nibs cooperate with each other to apply force to the mounting member in a direction away from the closed door.

5. The latch assembly of claim 1 wherein the cabinet has a front face with a rear surface around the cavity front opening and the rigid cabinet member abuts the rear surface of the front face, said front face and rigid cabinet member having openings therethrough and the latch receiving strike plate of the mounting member is in alignment with the openings.

6. In the latch assembly of claim 5 wherein the opening in the rigid cabinet member is vertically longer than the opening in the front face and the resilient finger depends from the latch receiving strike plate and is received in the rigid cabinet member slot and abuts the rear surface of the front face.

7. In a microwave oven having a cabinet defining an oven cavity having a front opening, a door movably mounted to said cabinet for selectively closing said opening, electrically operable microwave energy generating means for supplying electromagnetic energy to said cavity, and means including a switch for providing electric power from an external source to said electrically operable microwave energy generating means, means including a latch for selectively securing said door in the closed position, and selectively operating said switch, the improvement comprising:

the switch secured to a mounting member, said mounting member having a latch receiving strike plate and a resilient finger, the mounting member is pivotally mounted at one end thereof to a rigid oven member and biased by the resilient finger in a direction away from the door in its closed position, said latch and mounting member strike plate being movable relative to each other to latched and unlatched positions and cooperating to tightly retain the door in its closed position by the biasing effect of the resilient finger when in the latched position, and means fixedly securing the mounting member against pivotal movement thereof when the latch and mounting member strike plate cooperate to tightly retain the door in its closed position.

8. In the microwave oven of claim 7 wherein means fixedly securing the mounting member against pivotal movement include an elongated slot opening in the mounting member and a headed screw fastener through the slot opening into a rigid oven member.

9. In the microwave oven of claim 8 wherein the slot opening has a set of upstanding nibs longitudinally along a side of the slot and the lower surface of the screw fastener head has a set of depending nibs which nibs cooperate with the nibs on the mounting member so that upon tightening of the screw fastener the sets of nibs cooperate with each other to apply force on the mounting member in a direction away from the closed door.

10. In the microwave oven of claim 7 wherein the cabinet has a front face around the cavity front opening and the rigid oven member abuts the rear surface of the front face, said front face and rigid oven member having openings therethrough and the strike plate of the mounting member is in alignment with the openings.

11. In the microwave oven of claim 10 wherein the opening in the rigid oven member is vertically longer than the opening in the front face and the resilient finger depends from the strike plate and is received in the rigid oven member slot and abuts the rear surface of the front face.

12. A method of assembling microwave ovens having a cabinet defining an oven cavity having a front opening, a door movably mounted to said cabinet for selectively closing said opening, electrically operable microwave energy generating means for supplying electromagnetic energy to said cavity, and means including a switch for providing electric power from an external source to said electrically operable microwave energy generating means, means including a latch for selectively securing said door in the closed position and selectively operating said switch means, comprising:

securing the switch to a mounting member, said mounting member having a latch receiving strike plate and a resilient finger, said strike plate and latch being movable relative to each other to latched and unlatched positions, mounting pivotally one end of the mounting member to a rigid oven member such that the resilient finger biases the mounting member in a direction away from the door in its closed position, closing tightly the door to engage the latch and strike plate of the mounting member in the latched position, and securing the mounting member to prevent pivotal movement thereof when the latch and strike plate of the mounting member cooperate to tightly retain the door in its closed position.

13. The method of assembling microwave ovens of claim 12 including the step of providing an elongated slot opening in the mounting member to receive a headed screw fastener through the slot opening into a rigid oven member and then tightening the screw fastener to secure the mounting member to prevent pivotal movement thereof.

14. The method of assembling microwave ovens of claim 13 including the steps of molding the mounting member from plastic material, forming a set of upstanding nibs longitudinally along a side of the slot, forming a set of depending nibs on the lower surface of the screw fastener head, and tightening the screw fastener such that the sets of nibs cooperate with each other to apply force to the mounting member in a direction away from the closed door.

* * * * *